US007905217B2

(12) United States Patent
Namari et al.

(10) Patent No.: US 7,905,217 B2
(45) Date of Patent: Mar. 15, 2011

(54) ELECTRONIC FUEL INJECTION CONTROL DEVICE

(75) Inventors: Takashi Namari, Tochigi (JP); Masato Ono, Tochigi (JP)

(73) Assignee: Keihin Corporation, Tokyo (JP)

( * ) Notice: Subject to any disclaimer, the term of this patent is extended or adjusted under 35 U.S.C. 154(b) by 114 days.

(21) Appl. No.: 11/497,314

(22) Filed: Aug. 2, 2006

(65) Prior Publication Data

US 2007/0028898 A1 Feb. 8, 2007

(30) Foreign Application Priority Data

Aug. 5, 2005 (JP) ..... 2005-227361

(51) Int. Cl.

| | |
|---|---|
| ***F02D 41/06*** | (2006.01) |
| ***F02M 1/00*** | (2006.01) |
| ***F02M 51/00*** | (2006.01) |
| ***F02M 37/04*** | (2006.01) |

(52) U.S. Cl. ..... 123/491; 123/179.17; 123/497

(58) Field of Classification Search ..... 123/491, 123/478, 406.47, 406.53, 497, 179.17, 490
See application file for complete search history.

(56) References Cited

U.S. PATENT DOCUMENTS

| | | | | |
|---|---|---|---|---|
| 5,105,786 | A * | 4/1992 | Kato | 123/449 |
| 5,419,291 | A * | 5/1995 | Kimata et al. | 123/179.16 |
| 5,655,502 | A * | 8/1997 | Enomoto et al. | 123/502 |
| 5,870,986 | A * | 2/1999 | Ichinose | 123/179.16 |
| 5,954,782 | A * | 9/1999 | Togai | 701/105 |
| 6,298,830 | B1 * | 10/2001 | Kono | 123/478 |
| 6,354,274 | B1 * | 3/2002 | Shima et al. | 123/478 |
| 6,513,485 | B2 * | 2/2003 | Ogawa et al. | 123/295 |
| 6,535,811 | B1 * | 3/2003 | Rowland et al. | 701/115 |
| 6,782,870 | B2 * | 8/2004 | Ishida | 123/449 |
| 6,840,228 | B2 * | 1/2005 | Yomogida et al. | 123/494 |
| 6,854,450 | B2 * | 2/2005 | Kitagawa et al. | 123/491 |
| 6,971,370 | B2 * | 12/2005 | Suenaga et al. | 123/436 |
| 6,978,759 | B2 * | 12/2005 | Iriya et al. | 123/295 |

(Continued)

FOREIGN PATENT DOCUMENTS

| | | |
|---|---|---|
| JP | 6-2586 | 1/1994 |

(Continued)

OTHER PUBLICATIONS

Japanese Office Action dated Mar. 17, 2008.

*Primary Examiner* — Stephen K Cronin
*Assistant Examiner* — Sizo B Vilakazi
(74) *Attorney, Agent, or Firm* — Kratz, Quintos & Hanson, LLP

(57) ABSTRACT

An electronic fuel injection control device of the present invention has at least a fuel injection device for injecting a fuel devoted to a combustion, and a power source circuit for rectifying and stabilizing an alternating-current voltage generated, based on a rotation of a crank shaft; controls the fuel injection device in an internal combustion engine started by rotating the crank shaft through a manual operation; and further has a power source voltage detection mechanism for detecting a value of a power source voltage supplied to the injection device by the circuit, and an Information processing mechanism for starting an operation when receiving a supply of a direct-current voltage from the circuit, initializing itself, inputting a power source voltage value detected by the detection mechanism, and instructing a first fuel injection for the fuel injection device when the input voltage value attains a predetermined voltage value.

5 Claims, 6 Drawing Sheets

U.S. PATENT DOCUMENTS

| | | | | |
|---|---|---|---|---|
| 7,089,916 | B2 * | 8/2006 | Abo et al. | 123/490 |
| 7,177,755 | B2 * | 2/2007 | Nishikawa et al. | 701/112 |
| 7,318,415 | B2 * | 1/2008 | Fukasawa | 123/458 |
| 2002/0026925 | A1 * | 3/2002 | Yuya | 123/406.53 |
| 2002/0046730 | A1 * | 4/2002 | Hosokawa et al. | 123/295 |
| 2003/0037771 | A1 * | 2/2003 | Yuya et al. | 123/491 |
| 2003/0150424 | A1 * | 8/2003 | Min | 123/406.33 |
| 2004/0025839 | A1 * | 2/2004 | Kashibata et al. | 123/406.47 |
| 2004/0060543 | A1 * | 4/2004 | Ishida | 123/449 |
| 2005/0005914 | A1 * | 1/2005 | Tamechika et al. | 123/478 |
| 2005/0081825 | A1 * | 4/2005 | Suenaga et al. | 123/446 |
| 2005/0120990 | A1 * | 6/2005 | Hori | 123/179.5 |
| 2006/0278200 | A1 * | 12/2006 | Namari et al. | 123/491 |

FOREIGN PATENT DOCUMENTS

| | | | |
|---|---|---|---|
| JP | 06-10730 | | 1/1994 |
| JP | 08-177552 | | 7/1996 |
| JP | 2004-162691 | | 6/2004 |
| JP | 2005-030250 | | 2/2005 |
| JP | 2005030250 | A * | 2/2005 |
| JP | 2005-106000 | | 4/2005 |
| JP | 2006-29303 | | 2/2006 |

* cited by examiner

Case of Manual Operation Start From Exhaust Stroke

Case of Manual Operation Start From Suction Stroke

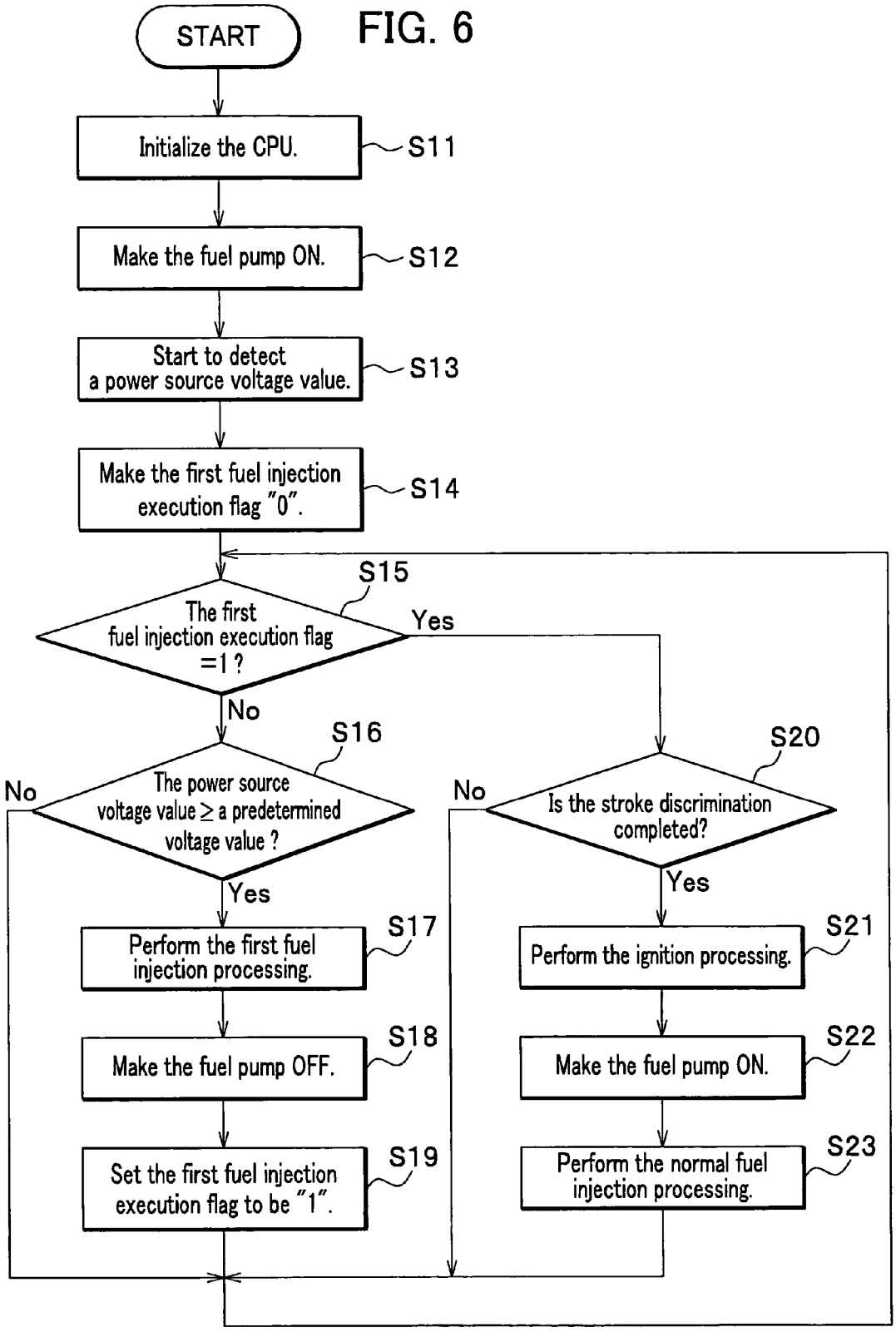
FIG. 6
START
Initialize the CPU.
S11
Make the fuel pump ON.
S12
Start to detect a power source voltage value.
S13
Make the first fuel injection execution flag "0".
S14
S15
The first fuel injection execution flag =1 ?
Yes
No
S16
The power source voltage value ≥ a predetermined voltage value ?
No
Yes
S17
Perform the first fuel injection processing.
S18
Make the fuel pump OFF.
S19
Set the first fuel injection execution flag to be "1".
S20
Is the stroke discrimination completed?
No
Yes
S21
Perform the ignition processing.
S22
Make the fuel pump ON.
S23
Perform the normal fuel injection processing.

ELECTRONIC FUEL INJECTION CONTROL DEVICE

BACKGROUND OF THE INVENTION

1. Field of the Invention

The present invention relates to an electronic fuel injection control device of an internal combustion engine (hereinafter simply referred to as "engine") where a battery is not mounted and that is started by manual operation.

2. Description of the Related Art

In these years an electronic fuel injection device starts to be applied to an engine of such a small size bike and an agricultural implement where a battery is not mounted. An engine where a battery is not mounted rotates a crank shaft of the engine by such a kick starter and a recoil starter through a manual operation, rotates a generator by its rotation, and obtains power. Then supplying the obtained power to its electronic fuel injection device and igniter, the engine starts. Then if the engine once starts, stable power can be obtained from the generator, and thereafter, the engine can continuously operate by itself.

Whereas, in a case that a sufficient rotation force by such a kick starter, that is, sufficient power cannot be obtained, various inconveniencies such as not only a start failure but also a discharge of non-combustion gas due to such a cause that a supply pressure (hereinafter referred to as "fuel pressure") of a fuel from a fuel pump is not stable in a first fuel injection in some case. Consequently, in order to solve such the inconveniencies, for example, in Japanese Patent Laid-Open Publication Hei. 6-2586 (paragraphs 30 to 40, FIGS. 3 to 7), a start failure due to such a fuel supply shortage is adapted to be prevented by injecting a fuel for a predetermined time soon after a controller (microcomputer) of a fuel injection device rises, without waiting for a normal fuel injection timing.

Generally, a power source voltage supplied to a microcomputer is often lower than that supplied to a fuel injection device and a fuel pump. Therefore, when the microcomputer of a controller rises, the fuel injection device and the fuel pump are not always normally actuated; if the microcomputer normally rises, a response time to an injection instruction becomes longer, and a fuel pressure cannot be heightened. Particularly, a case that a rotation force given to a generator by such a kick starter is weak often falls in such the situation.

The Japanese Patent Laid-Open Publication Hei. 6-2586 assumes that a fuel injection time for injecting a fuel when a microcomputer of a controller rises is simply defined as a temperature function of engine cooling water. In other words, in the Japanese Patent Laid-Open Publication Hei. 6-2586, a performance degradation is not considered in such a case that a power source voltage supplied to a fuel injection device and a fuel pump do not attain a rated voltage when the microcomputer rises. Therefore, it occurs in some case that: a proper amount of a fuel is not injected by the fuel injection device; a start cannot be achieved, failing to ignite; and an excessive fuel is supplied.

In view of the problems of such the conventional technology, there is a need for a fuel injection control device that can prevent a wasteful fuel injection in a first fuel injection for starting an engine where a battery is not mounted and enables a proper amount of a fuel in the first fuel injection.

In addition, there is a need for a fuel injection control device that can spare power till a finish of first ignition processing after a first fuel injection in a start of an engine where a battery is not mounted.

SUMMARY OF THE INVENTION

A first aspect of the present invention is an electronic fuel injection control device that: has at least a fuel injection device for injecting a fuel devoted to a combustion, and a power source circuit for rectifying and stabilizing an alternating-current voltage generated, based on a rotation of a crank shaft; controls the fuel injection device in an internal combustion engine started by rotating the crank shaft by manual operation; and further comprises a power source voltage detection mechanism for detecting a value of a power source voltage supplied to the fuel injection device by the power source circuit; and an information processing mechanism for starting an operation when receiving a supply of a direct-current voltage, initializing itself, inputting a power source voltage value detected by the power source voltage detection mechanism, and instructing a first fuel injection for the fuel injection device when the input voltage attains a predetermined voltage value.

In accordance with the first aspect of the present invention, if a voltage is supplied from a power source circuit by power generated through a manual operation by a crank shaft being rotated, an information processing mechanism (that is, a computer for fuel injection control) starts an operation and initializes itself. In addition, the power source detection mechanism detects a value of a power source voltage supplied to the fuel injection device from the power source circuit. Consequently, if the information processing mechanism finishes own initialization, it inputs the power source voltage value detected by the power source voltage mechanism and checks whether or not the input voltage value has attained a predetermined voltage value. Then, when the input voltage value, that is, the value of the power source voltage supplied to the fuel injection device attains the predetermined voltage value, the information processing mechanism instructs a first fuel injection for the device.

In other words, before the value of the power source voltage supplied to the fuel injection device attains a predetermined voltage value, for example, before it attains a voltage where a fuel pressure is stabilized, a first fuel injection is not instructed for the fuel injection device. Accordingly, in such a case that a rotation force given to a generator by such a kick starter is weak and sufficient power cannot be obtained, neither a fuel injection nor an ignition is not performed. In other words, a wasteful fuel injection can be prevented. Accordingly, an insufficient amount of a fuel injection is performed for an ignition, the fuel does not combust, and thus it is possible to prevent a state of non-combustion gas being exhausted.

A second aspect of the present invention is an electronic fuel injection control device described in the first aspect, wherein an information processing mechanism thereof comprises a first fuel injection standard time memory mechanism for considering a response time till starting a fuel injection and a fuel pressure of a fuel pump that supplies a fuel to the fuel injection control device when the fuel injection device receives a fuel injection instruction signal; making a first fuel injection standard time set in advance correspond to every value of the power source voltage; and memorizing the first fuel injection standard time, and in the first fuel injection processing, the information processing mechanism refers to the memory mechanism and derives the first fuel injection standard time, based on the power source voltage value detected by the power source voltage detection mechanism; performs a compensation computation defined in advance according to an engine temperature input from a temperature sensor that detects a temperature of the internal combustion engine for the derived first fuel injection standard time; and outputs a signal for instructing a fuel injection to the fuel injection device, making an obtained value by the computation a fuel injection time of a first fuel injection.

In accordance with the second aspect of the present invention, the information processing mechanism decides a first fuel injection time by considering not only an engine temperature (temperature of engine cooling water) but also a power source voltage supplied to a fuel injection device and a fuel pump, that is, a response time and a fuel pressure. Therefore, even in a case that a first fuel injection is performed before a power source voltage supplied to the fuel injection device and the fuel pump attains a rated value, it is possible to accurately control a fuel injection amount of the device to a proper amount.

A third aspect of the present invention is an electronic fuel injection control device described in the first or second aspect, wherein when an information processing mechanism thereof performs ignition processing of instructing to perform a first ignition for an igniter of the internal combustion engine, it performs stroke discrimination processing with respect to the internal combustion engine in advance of the ignition processing; and when the stroke discrimination processing is enabled, the mechanism performs the ignition processing, and following fuel injection processing according to normal fuel injection processing.

In accordance with the third aspect of the present invention, by performing stroke discrimination processing, it becomes possible to perform an ignition upon confirming a correct timing, that is, a compression stroke, thereby to smoothly start an engine, and to continue a following fuel injection and ignition.

A fourth aspect of the present invention is an electronic fuel injection control device described in any one of the first to third aspects, wherein when an information processing mechanism thereof finishes own initialization, it outputs an ON signal for instructing ON of a power source of the fuel pump; when it finishes the first fuel injection processing, it outputs an OFF signal for instructing OFF of the power source of the fuel pump; and when it finishes first ignition processing, it outputs the ON signal for instructing ON of the power source of the fuel pump.

In accordance with the fourth aspect of the present invention, because the power source of the fuel pump is made OFF from a first fuel injection device finish to a first ignition finish, it becomes possible to spare consumption power specifically in a start initial stage when sufficient power is not generated. Then it becomes possible to effectively use the spared power for such ignition processing.

BRIEF DESCRIPTION OF THE DRAWINGS

FIG. 6 is a flowchart showing an example of processing flow related to fuel injection control performed by an information processing unit of a fuel injection control device in an embodiment of the present invention.

BEST MODE FOR CARRYING OUT THE INVENTION

Figure 1:
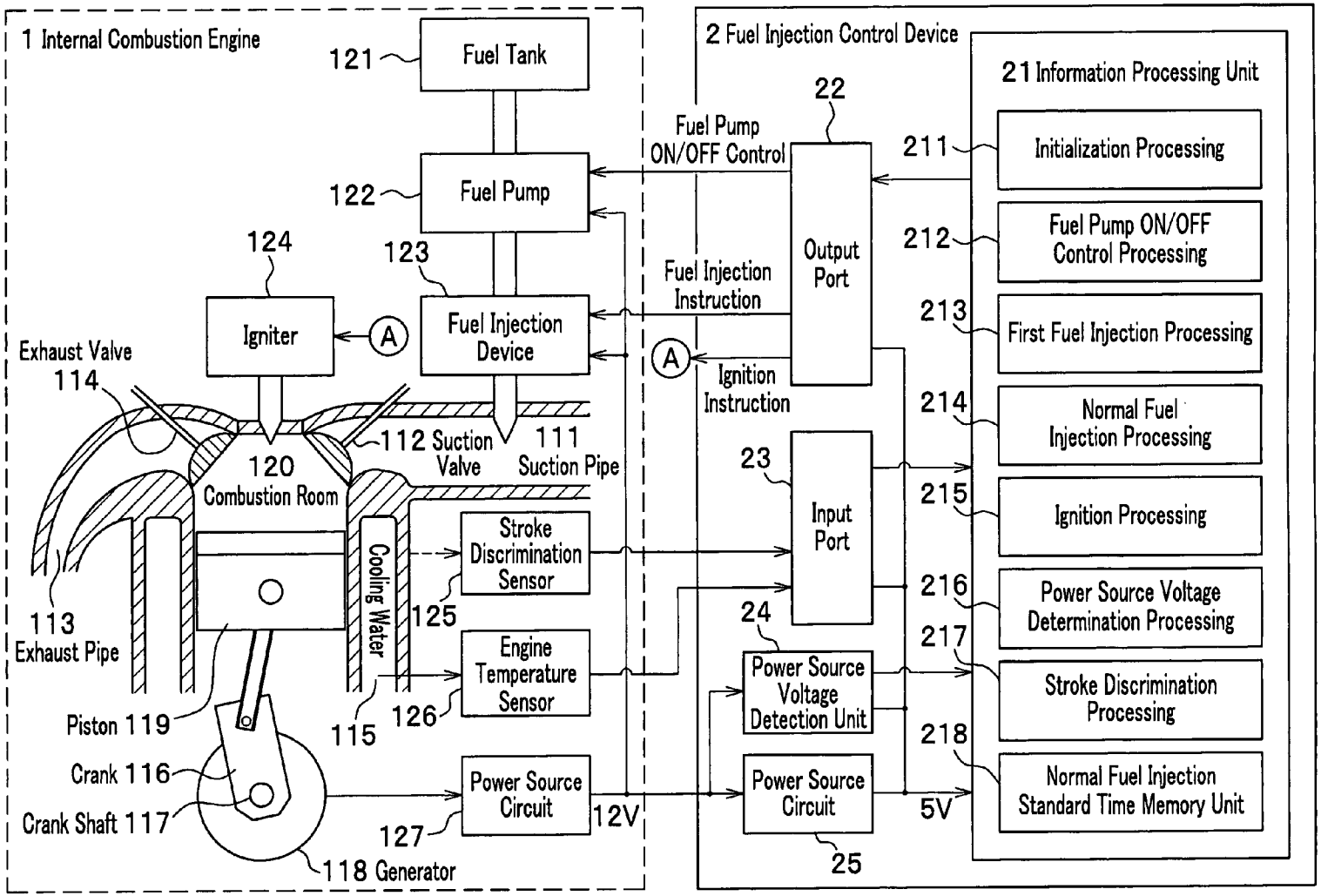
FIG. 1 is a drawing showing an example of a general configuration of a fuel injection control device and a main part of an internal combustion engine, where the device is applied, related to an embodiment of the present invention.

Here will be described an embodiment of the present invention in detail, referring to drawings as needed. FIG. 1 is a drawing showing an example of a general configuration of a fuel injection control device and a main part of an internal combustion engine, where the device is applied, related to the embodiment of the present invention.

In FIG. 1 an internal combustion engine 1 is a so called four-cycle engine, and an operation thereof is configured with four strokes of a suction, a compression, an expansion (combustion), and an exhaust. In other words, in the suction stroke a suction valve 12 is opened, and a mixture gas of air staying in a suction pipe 111 and a fuel is sucked in a combustion room 120. Next, in the compression stroke the mixture gas in the combustion room 120 is compressed by a piston 119, the fuel gas is ignited by an igniter 124 just before the piston 119 attains a top dead center. The fuel gas explosively expands if it combusts, and enters the expansion stroke. In the expansion stroke the piston 119 is pushed back by the explosion of the fuel gas, and a force thereof is converted to a rotation force of a crank shaft 117 through a crank 116. Next, in the exhaust stroke an exhaust valve 114 is opened, and the fuel gas within the combustion room 120 is exhausted outside through an exhaust pipe 113.

In order to repeat the four strokes, it is requested for the mixture gas to be produced in the suction pipe 111 by the finish of the suction stroke. Consequently, a fuel injection device 123 injects a fuel in the suction pipe 111 at an approximately first half timing of the exhaust stroke. The fuel injection device 123 comprises an injection valve not shown, and injects a fuel supplied from a fuel tank 121 and pressurized by a fuel pump 122. In addition, the fuel injection device 123 receives a fuel injection instruction signal from a fuel injection control device 2, and opens/closes the injection valve.

The internal combustion engine 1 is started by manual operation (here, an operation by a human using such a hand and a foot is collectively referred to "manual operation") of a kick starter or a recoil starter not shown. In other words, if manually operating the kick starter or the recoil starter, the crank 116 and the crank shaft 117 are rotated, and a reciprocating motion of the piston 119 is started. In addition, if the crank shaft 117 is rotated, a generator 118 attached to such a flywheel rotated by a rotation force of the crank shaft 117 starts to generate power. At this time the generator 118 generates an alternating-current voltage, it is rectified and stabilized by a power source circuit 127, and is supplied to such the fuel injection control device 2, the fuel injection device 123, the fuel pump 122, and the igniter 124 as a direct-current voltage of a predetermined voltage (for example, 12 V). Meanwhile, as the power source circuit 127 is normally used such a regulator and rectifier.

On the other hand, the fuel injection control device 2 comprises an information processing unit 21; an output port 22 for the unit 21 to output a control signal outside; an input port 23 for the unit 21 to input an external signal; a power source voltage detection unit 24 for detecting a value of a power source voltage supplied from the power source circuit 127 to the fuel injection device 123 and the fuel pump 122; and a second power source circuit 25 for converting a direct-current voltage of, for example, 12 V supplied from the power source circuit 127 to that of, for example, 5 V supplied to each component of the fuel injection control device 2. Here, the information processing unit 21 is a so called computer, and comprises a CPU (Central Processing Unit) not shown and a memory.

Here, the information processing unit 21, the output port 22, and the input port 23 can be configured with such a microprocessor of one chip of a large scale integrated circuit by semiconductor. In addition, although an A/D (Analog to Digital) converter is used in the power source voltage detection unit 24, it may be built in the microprocessor.

The memory of the information processing unit 21 memorizes programs such as initialization processing 211, fuel pump ON/OFF control processing 212, first fuel injection processing 213, normal fuel injection processing 214, ignition processing 215, power source voltage determination processing 216, and stroke discrimination processing 217. The programs are run by the CPU, and thereby, a predetermined function is realized that is defined in the fuel injection control device 2. Meanwhile, contents of the programs will be described later. In addition, a part of an area of the memory is used as a first fuel injection standard time memory unit 218.

The output port 22 comprises such an output register and an output drive circuit for every output signal, and outputs control signals such as a fuel pump ON/OFF control signal for controlling ON/OFF of the power source of the fuel pump 122; a fuel injection instruction signal for instructing a fuel injection to the fuel injection device 123; and an ignition instruction signal for instructing an ignition to the igniter 124. In addition, the input port 23 comprises such an input buffer register, and in some case, an A/D converter as needed. The input port 23 is connected to such a stroke discrimination sensor 125 and an engine temperature sensor 126 and reads information output by the sensors.

Figure 2:
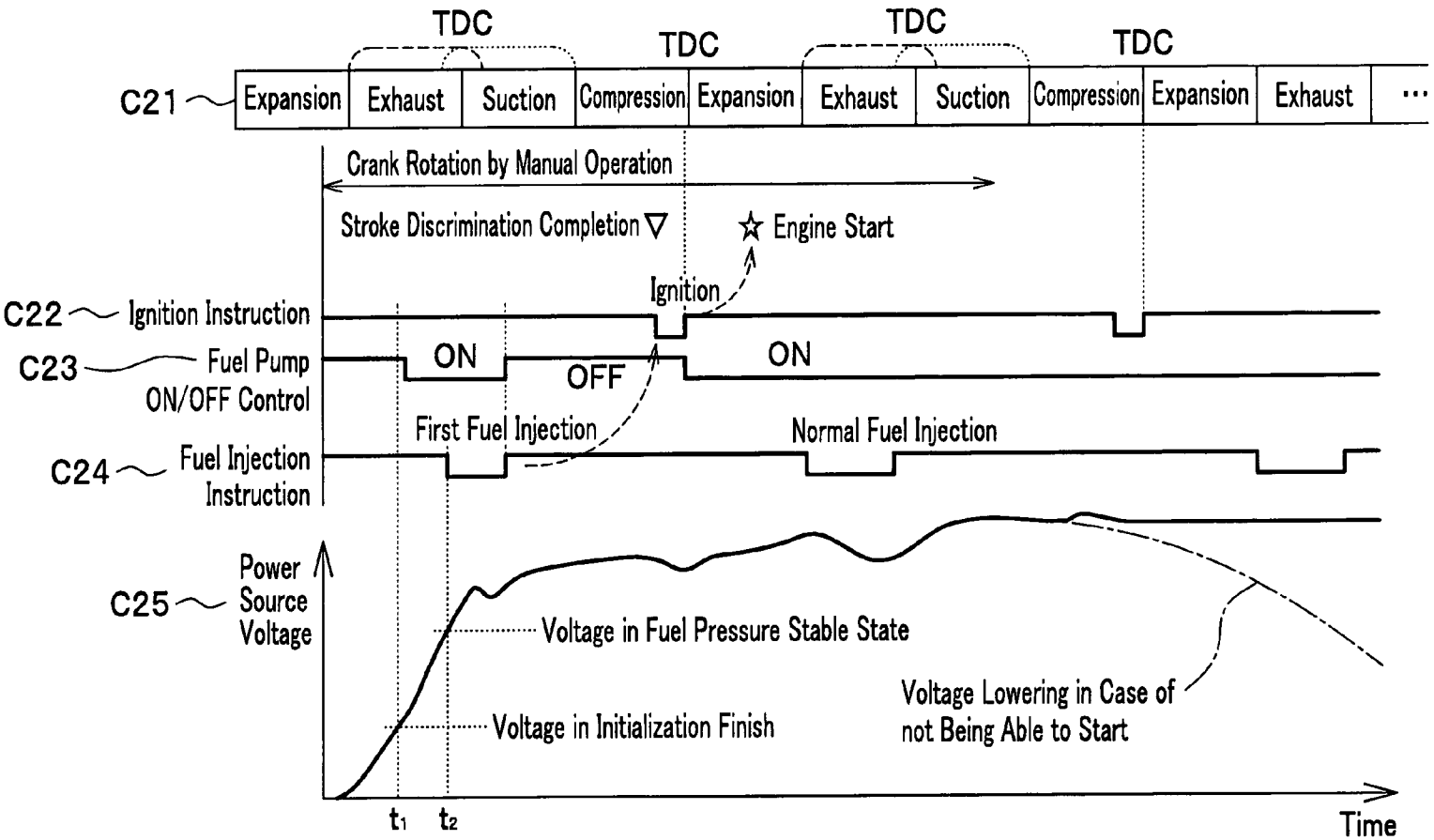
FIG. 2 is a drawing showing an example of time charts of a stroke of an internal combustion engine; a control signal output by a fuel injection control device, corresponding to the stroke; and a power source voltage output by a power source circuit, in a case that the engine where the device of the present invention is applied is started from an exhaust stroke by manual operation.
Figure 3:
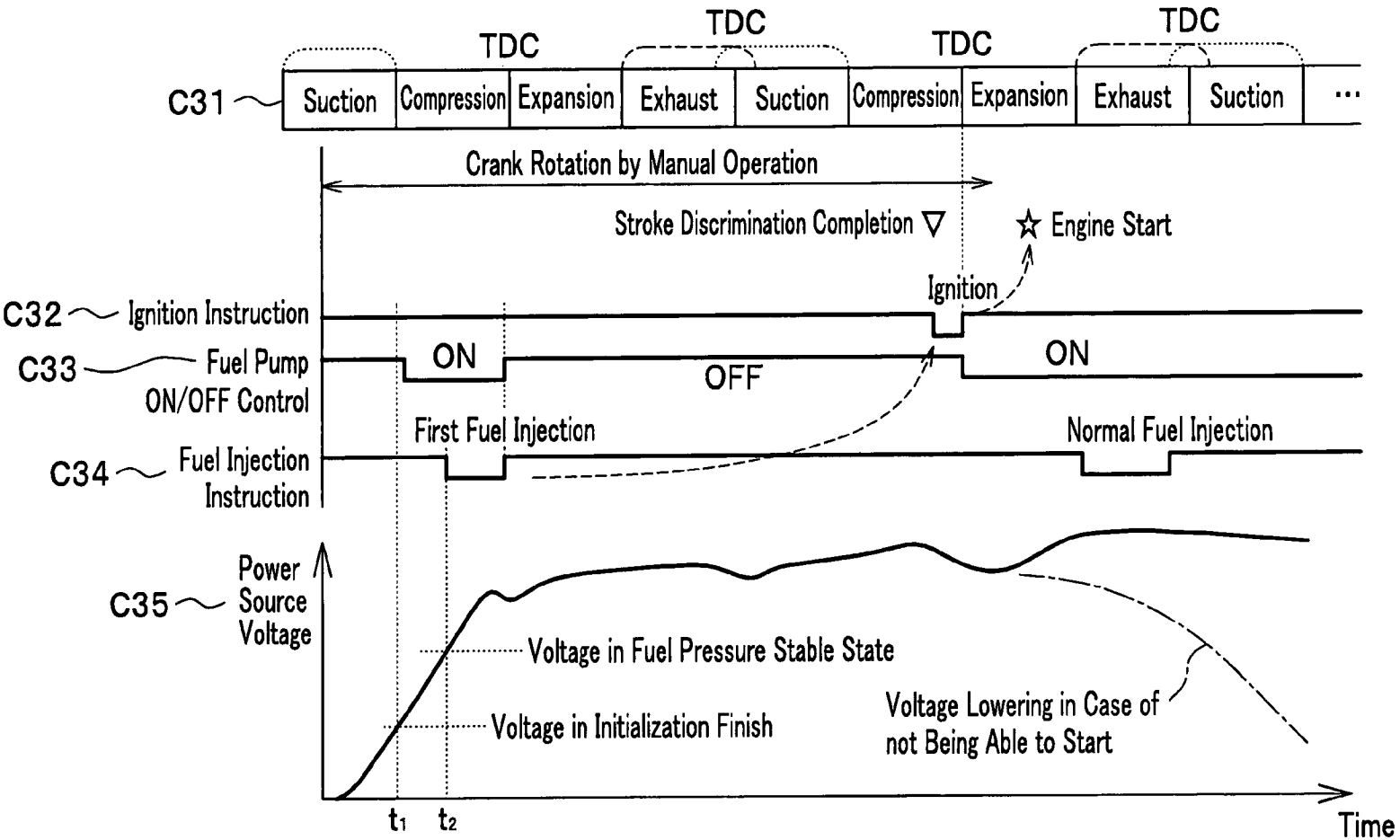
FIG. 3 is a drawing showing an example of time charts of a stroke of an internal combustion engine; a control signal output by a fuel injection control device, corresponding to the stroke; and a power source voltage output by a power source circuit, in a case that the engine where the device of the present invention is applied is started from a suction stroke by manual operation.

Next will be described an operation of the fuel injection control device 2 in detail, referring to FIGS. 2 and 3 (see FIG. 1 as needed). FIG. 2 is a drawing showing an example of time charts of a stroke of an internal combustion engine; a control signal output by a fuel injection control device, corresponding to the stroke; and a power source voltage output by a power source circuit, in a case that the engine is started from an exhaust stroke by manual operation. In addition, FIG. 3 is a drawing showing an example of time charts of: a stroke of an internal combustion engine; a control signal output by a fuel injection control device, corresponding to the stroke; and a power source voltage output by a power source circuit, in a case that the engine is started from a suction stroke by manual operation.

If manually operating such a kick starter, the crank shaft 117 starts to rotate, thereby the generator 118 is rotated, and an alternating-current voltage is generated. The power source circuit 127 rectifies the alternating-current voltage and stabilizes it to a direct-current voltage of a predetermined voltage (for example, 12 V). At this time, in order for a power source voltage output from the power source circuit 127 to be stabilized to the predetermined voltage, a rise time is requested, depending on such a rotation speed obtained by the crank shaft 117 and a load connected to an output. C 25 in FIG. 2 is a time chart showing a rise manner of a power source voltage output from the power source circuit 127.

Meanwhile, time charts shown in FIG. 2 make a stroke time chart C21 of the internal combustion engine 1 a reference, and in this case, the chart C21 is a time chart of starting a manual operation from an exhaust stroke. However, although the stroke is not known till the stroke discrimination processing 217 is finished, a stroke name is written in FIG. 2, which the name is calculated back from a stroke discrimination finish timing for convenience. Meanwhile, in the stroke time chart C21, TDC (Top Dead Center) indicates a top dead center timing.

In FIG. 1, for example, a direct-current voltage of a power source voltage of 12 V is output from the power source circuit 127 and is supplied to such the fuel pump 122, the fuel injection device 123, the igniter 124, and the fuel injection control device 2. In addition, a direct-current voltage of a power source voltage of 5 V obtained by a DC/DC or regulator conversion of the direct-current voltage of the power source voltage of 12 V is output from the power source circuit 25 within the fuel injection control device 2 and is supplied to such the information processing unit 21, the output port 22, the input port 23, and the power source voltage detection unit 24.

At this time, to the information processing unit 21 including the CPU is supplied the power source voltage of 5 V of the lower voltage; in addition, to the fuel injection device 123 and the fuel pump 122 is supplied the power source voltage of 12 V of the higher voltage. Therefore, an operation of the fuel injection control device 2, that is, the operation of the information processing unit 21 often rises earlier than the fuel injection device 123 and the fuel pump 122. Accordingly, even if attempting to operate the fuel injection device 123 and the fuel pump 122 as soon as the information processing unit 21 rises, they do not operate; if they operate, they cannot bring out sufficient performances in some case.

Figure 4:
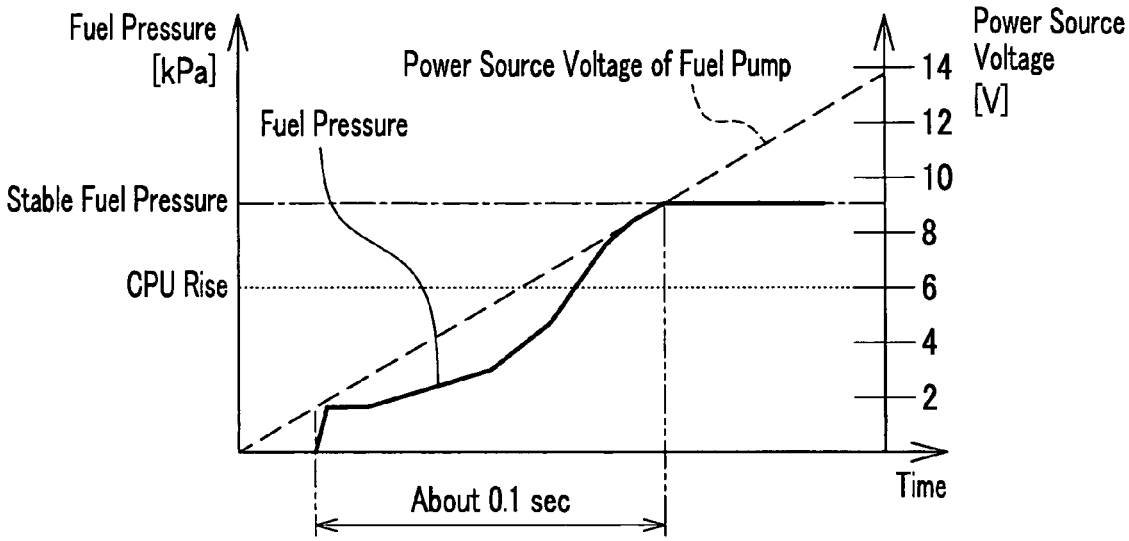
FIG. 4 is a drawing showing an example of a power source dependence characteristic of a fuel pump fuel pressure in an internal combustion engine of the present invention where a fuel injection control device is applied.
Figure 5:
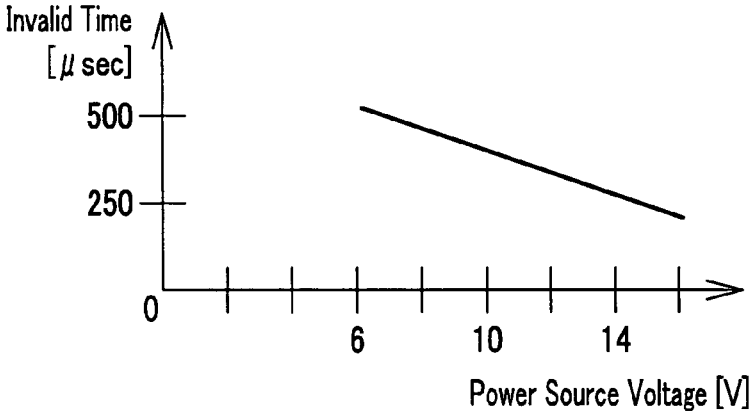
FIG. 5 is a drawing showing an example of a power source dependence characteristic of an invalid time of a response in an internal combustion engine of the present invention where a fuel injection control device is applied.

In this connection, the performances of the fuel injection device 123 and the fuel pump 122 depend on power source voltages as respectively shown in FIGS. 4 and 5. Here, FIG. 4 is a drawing showing an example of a power source dependence characteristic of a fuel pump fuel pressure in an internal combustion engine; FIG. 5 is a drawing showing an example of a power source dependence characteristic of an invalid time of a response in an internal combustion engine.

As shown in FIG. 4, if a supplied voltage becomes around 2V, the fuel pump 122 starts an operation though it is unstable; however, a fuel pressure obtained by the pump 122 is not stabilized if the power source voltage becomes around 9 V. Accordingly, during that time, about 0.1 second, the fuel pressure is in an unstable state. On the other hand, if a supplied voltage becomes 5 V, the CPU of the information processing unit 21 starts an operation and performs a predetermined initialization processing 211.

Meanwhile, here, the initialization processing 211 means processing of setting an output level of the output port 22 to be a predetermined initial level and initializing a bare minimum of variables allotted to a stack pointer and a memory used in a program by the CPU. Then a timing when the initialization processing 211 is finished means that the CPU, that is, the information processing unit 21 or the fuel injection control device 2 has risen.

At the timing when the CPU rises, a power source voltage supplied to the CPU, that is, the information processing unit 21 is 5 V. In other words, even considering a loss of a conversion of the power source circuit 25, a power source of 12 V supplied to the fuel pump 122 does not yet attain around 6 V. Accordingly, a fuel pressure of the fuel pump 122 is not stabilized.

In addition, as shown in FIG. 5, an invalid time of a response of the fuel injection device 123 becomes smaller as a supplied power source becomes larger. In other words, a response speed of the fuel injection device 123 becomes faster. Here, the invalid time of the response of the fuel injection device 123 means a time from when the device 123 receives a fuel injection instruction signal to when the injection valve is actually opened.

In the embodiment, considering an actual state that the performances of the fuel pump 122 and the fuel injection device 123 lower before the power source voltage attains a predetermined rated voltage, it is adapted to output signals for controlling the pump 122 and the device 123 from the fuel injection control device 2. In addition, because generation power is by manual operation during a period when the power source voltage rises, sufficient power is not supplied during the period. Consequently, the control signal output to the fuel pump 122 controls to spare power thereof. Hereafter, returning to FIG. 2 will be described such an output timing of the control signals.

In the information processing unit 21, if a power source voltage supplied thereto becomes 5 V (that is, an output voltage from the power source circuit 127 is around 6 V), an operation of the unit 21 starts, and the unit 21 performs the initialization processing 211. In the C25 of FIG. 2, a timing is shown as t1 when the performance is finished. If the initialization processing 211 is finished, the information processing unit 21 performs the fuel pump ON/OFF control processing 212, firstly making a fuel pump ON/OFF control signal C23 ON, and thereby making the power source of the fuel pump 1220N. Thus by making the fuel pump 1220N just after the initialization processing 211 is finished, it is possible to early stabilize the fuel pressure of the pump 122.

Next, the information processing unit 21 performs the power source voltage discrimination processing 216, inputs a value of a power source voltage (value of the power source voltage supplied from the power source circuit 127 to the fuel pump 122 and the fuel injection device 123) detected by the power source voltage detection unit 24, and determines whether or not the power source voltage value has attained a voltage value (see FIG. 4) in a stable state of a fuel pressure. Then, when the power source voltage value attains the voltage value in the stable state of the fuel pressure (timing shown as t2 in the C25 of FIG. 2), the information processing unit 21 performs the first fuel injection processing 213, outputs a fuel injection instruction signal C24, and instructs a first fuel injection.

At this time the information processing unit 21 refers to the first fuel injection standard time memory unit 218 and derives a first fuel injection standard time according to the power source voltage value, based on the value input from the power source voltage detection unit 24. Then the information processing unit 21 performs a compensation computation of the derived first fuel injection standard time for an engine temperature obtained from the engine temperature sensor 126, and defines a first fuel injection time. The first fuel injection time thus derived is transmitted to the fuel injection device 123 by a pulse width of the fuel injection instruction signal C24. In other words, the fuel injection device 123 may open a valve thereof while the fuel injection instruction signal C24 is an "L" level (active level).

Here, the first fuel injection standard time memory unit 218 is a table where a first fuel injection standard time is memorized in a memory, corresponding to every value of a power source voltage supplied to the fuel pump 122 and the fuel injection device 123 from the power source circuit 127. Then the table of the first fuel injection standard time is a table collected into one, considering in advance an injection requirement time of an effect where the power source voltage dependence characteristic of the fuel pressure of the fuel pump 122 shown in FIG. 4 and that of the invalid time of the response of the fuel injection device 123 shown in FIG. 5 are put together.

Accordingly, only once referring to the table, that is, the first fuel injection standard time memory unit 218 for a certain power source voltage, it is possible to derive a first fuel injection standard time where the power source voltage dependence characteristic of the fuel pressure of the fuel pump 122 and that of the invalid time of the response of the fuel injection device 123 are considered, corresponding to the power source voltage.

Next, the stroke discrimination sensor 125 comprises, for example, a crank angle sensor and a cam angle sensor (both not shown), and when detecting a reference position set at a predetermined angle, the sensor 125 inputs the detection signal in the information processing unit 21 through the input port 23. The information processing unit 21 receives the detection signal and performs the stroke discrimination processing 217. Meanwhile, in some case the stroke discrimination sensor 125 further comprises a gas pressure sensor (not shown) of the combustion room 120 and a suction pipe pressure sensor (not shown) for detecting a pressure of the suction pipe 111. In addition, in some case the stroke discrimination processing 217 discriminates a stroke according to a combination of signals from the gas pressure sensor and the suction pipe pressure sensor and those from the crank angle sensor and the cam angle sensor, and determines the stroke according to such a variation of an engine rotation speed.

The information processing unit 21 performs the stroke discrimination processing 217, and if completing a stroke discrimination, subsequently, it performs the ignition processing 215. In the ignition processing 215 the information processing unit 21 outputs an ignition instruction C22 for the igniter 124. If the igniter 124 receives the ignition instruction C22, it makes an ignition plug discharge spark, combusts and explodes a mixture gas within the combustion room 120, and pushes back the piston 119.

Meanwhile, at this time, because the power source of the fuel pump 122 was made OFF after the finish of the initial fuel injection, the information processing unit 21 performs the fuel pump ON/OFF control processing 212 just after the finish of the performance of the ignition processing 215, makes the fuel pump ON/OFF control signal C23 ON, and thereby makes the power source of the fuel pump 122 ON.

Thus the internal combustion engine 1 starts, and in a following injection timing the normal fuel injection processing 214 is performed. Meanwhile, in the normal fuel injection processing 214 a fuel injection time thereof is derived, as conventional performed, by calculating a predetermined function that makes an engine temperature, a rotation speed of the crank 116, and a suction air amount to be variables.

Although FIG. 2 thus described shows the time charts in a case of a manual operation start from an exhaust stroke, FIG. 3 is the time charts in a case of a manual operation start from a suction stroke. Accordingly, a difference between FIGS. 2 and 3 is to such a degree that timings between first ignition instructions C22, C32 differ according to a stroke transition (accordingly, fuel pump ON/OFF control signals C23, C33 and fuel injection instruction signals C24, C34 also differ). In other words, the difference is to such a degree that although in the case of FIG. 2 the igniter 124 is ignited at a first compression stroke, in the case of FIG. 3 the igniter 124 is not ignited at a first compression stroke and ignited at the next compression stroke because its stroke discrimination processing is not performed yet. Because other timings are almost same in FIGS. 2 and 3, a description of FIG. 3 will be omitted.

Meanwhile, in the case of a manual start operation from a suction stroke as shown in FIG. 3, because a stroke number requested from a first fuel injection to a stroke discrimination completion becomes more, a time till an ignition becomes longer. In such the case a fuel amount contained in a mixture gas becomes less due to such a leakage in some case. Consequently, the information processing unit 21 may also instruct an fuel injection of an additional injection amount (injection time) defined as needed for the fuel injection device 123 in a case of a detection of the TDC after the instruction of the first fuel injection even if it is before the stroke discrimination completion. Thus it is possible to further heighten a success probability of the first ignition and to more smoothly start the internal combustion engine 1.

Next will be described processing flow related to fuel injection control performed by the information processing unit 21. Here, FIG. 6 is a flowchart showing an example of processing flow related to fuel injection control performed by an information processing unit of a fuel injection control device.

In FIG. 6 the information processing unit 21 starts an operation if a supplied power source voltage thereof attains, for example, 5 V, it firstly performs the initialization processing 211 and initializes own CPU (step S11). Next, the information processing unit 21 performs the fuel pump ON/OFF control processing 212 and makes the fuel pump 1220N (step S12). Next, the information processing unit 21 starts to detect a value of a power source voltage supplied to the fuel pump 122 and the fuel injection device 123 from the power source circuit 127 by the power source voltage detection unit 24 (step S13). Next, the information processing unit 21 makes a first fuel injection execution flag "0" (step S14).

Next, the information processing unit 21 determines whether or not the first fuel injection execution flag is "1" (step S15). As a result of the determination, if the first fuel injection execution flag is not "1" (No in the step S15), the information processing unit 21 further determines whether or not the power source voltage value detected by the power source voltage detection unit 24 has attained a predetermined voltage value (voltage value in a stable state of a fuel pressure (step S16). As a result of the determination, if the power source voltage value has not attained the predetermined voltage value (No in the step S16), the information processing unit 21 returns to the step S15 and again performs the processing after the step S15.

On the other hand, in the determination of the step S16, if the power source voltage value detected by the power source voltage detection unit 24 has attained the predetermined voltage value (Yes in the step S16), the information processing unit 21 performs the first fuel injection processing 213 (step S17), and then the fuel pump ON/OFF control processing 212, and makes the fuel pump 122 OFF (step S18). Then the information processing unit 21 sets the first fuel injection execution flag "1" (step S19), returns to the step S15, and again performs the processing after the step S15.

In addition, in the determination of the step S15, if the first fuel injection execution flag is "1" (Yes in the step S15), the information processing unit 21 determines whether or not the stroke determination is completed, based on a signal from the stroke discrimination sensor 125, and a predetermined reference position is detected by such a crank position sensor (step S20). As the result, if the stroke determination is not completed, and the predetermined reference position is not detected (No in the step S20), the information processing unit 21 returns to the step S15 and again performs the processing after the step S15.

On the other hand, in the determination of the step S20, if the stroke discrimination is completed (Yes in the step S20), the information processing unit 21 performs the ignition processing 215 (step S21), performs the fuel pump ON/OFF control processing 212, and makes the fuel pump 1220N (step S22). Then the information processing unit 21 hereafter transits to a normal fuel injection processing mode, performs the normal fuel injection processing 214 in a next fuel injection timing (step S23), returns to the step S15, and again performs the processing after the step S15. In this case, because the first fuel injection execution flag is set "0" and the stroke discrimination is also completed, hereafter the ignition processing 215 and the normal fuel injection processing 214 are repeatedly performed, matching respective strokes.

Figure 7:
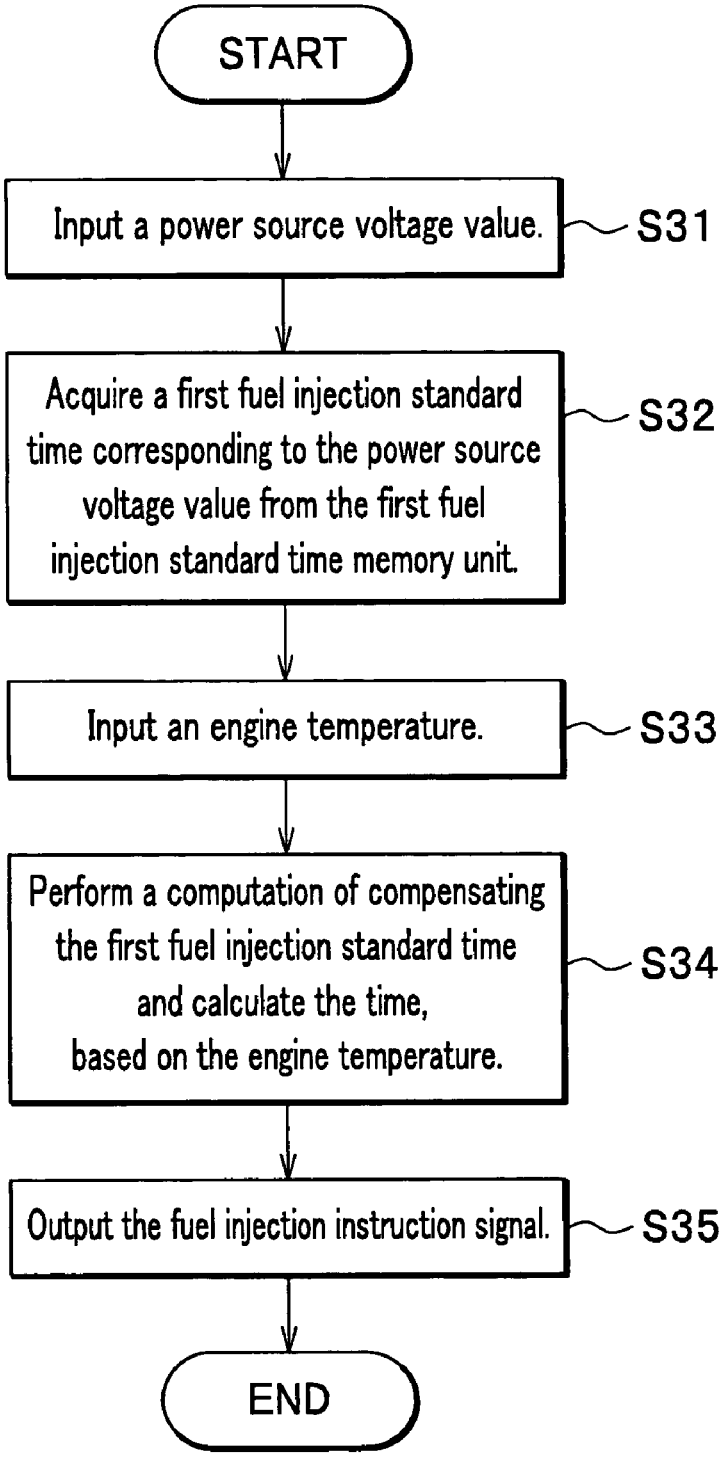
FIG. 7 is a flowchart showing an example of flow of first fuel injection processing out of processing by an information processing unit of a fuel injection control device in an embodiment of the present invention.

FIG. 7 is a flowchart showing an example of flow of first fuel injection processing out of processing performed by an information processing unit.

In FIG. 7 the information processing unit 21 firstly inputs a value of the power source voltage supplied to the fuel pump 122 and the fuel injection device 123 from the power source circuit 127 detected by the power source voltage detection unit 24 (step S31). Then based on the power source voltage value, the information processing unit 21 refers to the first fuel injection standard time memory unit 218 and acquires a first fuel injection standard time corresponding to the value therefrom (step S32).

On the other hand, the information processing unit 21 inputs an engine temperature from the engine temperature sensor 126 through the input port 23 (step S33), performs a computation of compensating the first fuel injection standard time acquired in the step S32 and calculates the time, based on the input engine temperature (step S34). Next, the information processing unit 21 outputs the fuel injection instruction signal C24 (C34) to the fuel injection device 123 (step S35). Meanwhile, in the step S35, upon making the fuel injection instruction signal C24 an "L" level (active level), the information processing unit 21 waits for an elapse of the first fuel injection standard time calculated in the step S34 and makes the signal C24 an "H" level (inactive level). Thus the information processing unit 21 can output a pulse having a time width of the first fuel injection standard time to the fuel injection instruction signal C24.

Thus in the embodiment, because the fuel injection control device 2 outputs the fuel injection instruction signal C24 (C34) for instructing a first fuel injection to the fuel injection device 123 after confirming that the value of the power source voltage supplied to the fuel pump 122 and the device 123 has attained a fuel pressure stable voltage, the signal C24 (C34) is not output in a case that the power source voltage value does not attain the fuel pressure stable voltage. Accordingly, in a case that such a kick starter is manually operated by weak force and sufficient power cannot be obtained from the generator 118, the power source voltage output by the power source circuit 127 cannot attain the fuel pressure stable voltage in some case. In such a case, because the fuel injection control device 2 does not output the fuel injection instruction signal C24 (C34), a fuel injection is not performed. In other words, in a case of the manual operation of the weak force, because the fuel injection device 123 does not react, a wasteful injection is not performed, and thus it is possible to prevent such non-combustion gas from being exhausted.

In addition, in the first fuel injection standard time derived in the first fuel injection processing 213, because the power source voltage dependence characteristic of the fuel pressure of the fuel pump 122 and that of the invalid time of the response of the fuel injection device 123 are considered in addition to the influence of an engine temperature, the device 123 can accurately inject a proper injection amount as a first fuel injection.

In addition, the power source of the fuel pump 122 is made ON at the finish of the initialization processing 211, OFF at the finish of the first fuel injection processing 213, and thereafter ON at the finish of first ignition processing 215. In other words, the power source of the fuel pump 122 is made OFF from the finish of the initialization processing 211 to that of the first ignition processing 215, and it is possible therebetween to spare limited power in an initial stage generated by the generator 118 and to effectively utilize the spared power for power of such the igniter 124.

Meanwhile, in the embodiment thus described, although the direct-current voltage output by the power source circuit 127 is described as 12 V, a voltage of 9 V to 15 V is normally often used. Accordingly, the direct-current voltage output by the power source circuit 127 is not limited to 12 V. In addition, similarly, because although the direct-current voltage output by the power source circuit 25 is described as 5 V, a microprocessor operated with a voltage 3 V or less is now already provided, the direct-current voltage is not limited to 5 V.

What is claimed is:

1. An electronic fuel injection control device for an internal combustion engine in which no battery is mounted and that includes a fuel injection device for injecting a fuel devoted to combustion, and a power source circuit for rectifying and stabilizing an alternating current voltage generated by a power source comprising a generator, based on a rotation of a crank shaft of the internal combustion engine being started by rotating the crank shaft through a manual operation, whereby electrical generation power is by manual operation during a period when the power source voltage rises; the electronic fuel injection control device comprising:

a power source voltage detector configured to detect a value of a power source voltage supplied to the fuel injection device by the power source circuit; and an information processor programmed to perform first fuel injection processing of a starting operation when receiving a supply of a direct current voltage from the power source circuit; to initialize itself inputting the power source voltage value detected by the power source voltage detection mechanism; and to instruct a first fuel injection for the fuel injection device when the input voltage value attains a predetermined voltage value;

wherein the information processor comprises means for performing first fuel injection processing of a starting operation when receiving a supply of a direct current voltage from the power source circuit; means for initializing itself inputting the power source voltage value detected by the power source voltage detection mechanism; and means for instructing a first fuel injection for the fuel injection device when the input voltage value attains a predetermined voltage value;

means for, when finishing own initialization, outputting from the information processor an ON signal for instruction ON of a power source of the fuel pump;

means for, when finishing the first fuel injection processing, outputting from the mechanism an OFF signal comprising means for instructing OFF of the power source of the fuel pump; and means for, when finishing first ignition processing, outputting from the mechanism the ON signal for instructing ON of the power source of the fuel pump.

2. An electronic fuel injection control device for an internal combustion engine in which no battery is mounted and that includes a fuel injection device for injecting a fuel devoted to combustion, and a power source circuit for rectifying and stabilizing an alternating current voltage generated by a power source comprising a generator, based on a rotation of a crank shaft of the internal combustion engine being started by rotating the crank shaft through a manual operation, whereby electrical generation power is by manual operation during a period when the power source voltage rises; the electronic fuel injection control device comprising:

a power source voltage detector configured to detect a value of a power source voltage supplied to the fuel injection device by the power source circuit; and an information processor programmed to perform first fuel injection processing of a starting operation when receiving a supply of a direct current voltage from the power source circuit; to initialize itself inputting the power source voltage value detected by the power source voltage detection mechanism; and to instruct a first fuel injection for the fuel injection device when the input voltage value attains a predetermined voltage value;

wherein the information processor comprises means for performing first fuel injection processing of a starting operation when receiving a supply of a direct current voltage from the power source circuit; means for initializing itself inputting the power source voltage value detected by the power source voltage detection mechanism; and means for instructing a first fuel injection for the fuel injection device when the input voltage value attains a predetermined voltage value;

means for performing ignition processing of instructing to perform a first ignition for an igniter of the internal combustion engine, means for the information processor performing stroke discrimination processing with respect to the internal combustion engine in advance of the ignition processing; and means for, when the stroke discrimination processing is enabled, the mechanism performing the ignition processing, and means for following fuel injection processing according to normal fuel injection processing;

said first fuel injection processing of starting an operation occurring at the initial start of the internal combustion engine;

means for performing ignition processing of instructing to perform a first ignition for an igniter of the internal combustion engine, means for the information processor performing stroke discrimination processing with respect to the internal combustion engine in advance of the ignition processing; and means for, when the stroke discrimination processing is enabled, the mechanism performing the ignition processing, and means for following fuel injection processing according to normal fuel injection processing;

means for, when finishing own initialization, outputting from the information processor an ON signal for instruction ON of a power source of the fuel pump; means for, when finishing the first fuel injection processing, outputting from the mechanism an OFF signal comprising means for instructing OFF of the power source of the fuel pump; and means for, when finishing first ignition processing, outputting from the mechanism the ON signal for instructing ON of the power source of the fuel pump.

3. An electronic fuel injection control device for an internal combustion engine in which no battery is mounted and that includes a fuel injection device for injecting a fuel devoted to combustion, and a power source circuit for rectifying and stabilizing an alternating current voltage generated by a power source comprising a generator, based on a rotation of a crank shaft of the internal combustion engine being started by rotating the crank shaft through a manual operation, whereby electrical generation power is by manual operation during a period when the power source voltage rises; the electronic fuel injection control device comprising:

a power source voltage detector configured to detect a value of a power source voltage supplied to the fuel injection device by the power source circuit; and an information processor programmed to perform first fuel injection processing of a starting operation when receiving a supply of a direct current voltage from the power source circuit to initialize itself inputting the power source voltage value detected by the power source voltage detection mechanism; and to instruct a first fuel injection for the fuel injection device when the input voltage value attains a predetermined voltage value;

wherein the information processor comprises means for performing first fuel injection processing of a starting operation when receiving a supply of a direct current voltage from the power source circuit; means for initializing itself inputting the power source voltage value detected by the power source voltage detection mechanism; and means for instructing a first fuel injection for the fuel injection device when the input voltage value attains a predetermined voltage value;

a first fuel injection standard time memory mechanism, coupled to the processor, including means for making a first fuel injection standard time correspond respectively to every value of the power source voltage; and means for memorizing the first fuel injection standard time, which the first fuel injection standard time is set in advance with means for considering a response time until starting a fuel injection and a fuel pressure of a fuel pump that supplies a fuel to the fuel injection control device when the fuel injection device receives a fuel injection instruction signal, and means for in the first fuel injection processing the information processor referring to the memory mechanism and deriving the first fuel injection standard time, based on the power source voltage value detected by the power source voltage detection mechanism;

mean for performing a compensation computation defined in advance according to an engine temperature input from a temperature sensor that detects a temperature of the internal combustion engine for the derived first fuel injection standard time; and means for outputting a signal comprising means for instructing a fuel injection to the fuel injection device, comprising means for making the obtained value by the computation a fuel injection time of the first fuel injection, said first fuel injection processing of starting an operation occurring at the initial start of the internal combustion engine;

means for, when finishing own initialization, outputting from the information processor an ON signal for instruction ON of a power source of the fuel pump; means for, when finishing the first fuel injection processing, outputting from the mechanism an OFF signal comprising means for instructing OFF of the power source of the fuel pump; and means for, when finishing first ignition processing, outputting from the mechanism the ON signal for instructing ON of the power source of the fuel pump.

4. An electronic fuel injection control device for an internal combustion engine in which no battery is mounted and that includes a fuel injection device for injecting a fuel devoted to combustion, and a power source circuit for rectifying and stabilizing an alternating current voltage generated by a power source comprising a generator, based on a rotation of a crank shaft of the internal combustion engine being started by rotating the crank shaft through a manual operation, whereby electrical generation power is by manual operation during a period when the power source voltage rises; the electronic fuel injection control device comprising;

a power source voltage detector configured to detect a value of a power source voltage supplied to the fuel injection device by the power source circuit; and an information processor programmed to perform first fuel injection processing of a starting operation when receiving a supply of a direct current voltage from the power source circuit; to initialize itself inputting the power source voltage value detected by the power source voltage detection mechanism; and to instruct a first fuel injection for the fuel injection device when the input voltage value attains a predetermined voltage value;

wherein the information processor comprises means for performing first fuel injection processing of a starting operation when receiving a supply of a direct current voltage from the power source circuit; means for initializing itself inputting the power source voltage value detected by the power source voltage detection mechanism; and means for instructing a first fuel injection for the fuel injection device when the input voltage value attains a predetermined voltage value;

a first fuel injection standard time memory mechanism, coupled to the processor, including means for making a first fuel injection standard time correspond respectively to every value of the power source voltage; and means for memorizing the first fuel injection standard time, which the first fuel injection standard time is set in advance with means for considering a response time until starting a fuel injection and a fuel pressure of a fuel pump that supplies a fuel to the fuel injection control device when the fuel injection device receives a fuel injection instruction signal, and means for in the first fuel injection processing the information processor referring to the memory mechanism and deriving the first fuel injection standard time, based on the power source voltage value detected by the power source voltage detection mechanism;

mean for performing a compensation computation defined in advance according to an engine temperature input from a temperature sensor that detects a temperature of the internal combustion engine for the derived first fuel injection standard time; and means for outputting a signal comprising means for instructing a fuel injection to the fuel injection device, comprising means for making the obtained value by the computation a fuel injection time of the first fuel injection, said first fuel injection processing of starting an operation occurring at the initial start of the internal combustion engine;

means for performing ignition processing of instructing to perform a first ignition for an igniter of the internal combustion engine, means for the information processor performing stroke discrimination processing with respect to the internal combustion engine in advance of the ignition processing; and means for, when the stroke discrimination processing is enabled, the mechanism performing the ignition processing, and means for following fuel injection processing according to normal fuel injection processing;

means for, when finishing own initialization, outputting from the information processor an ON signal for instruction ON of a power source of the fuel pump; means for, when finishing the first fuel injection processing, outputting from the mechanism an OFF signal comprising means for instructing OFF of the power source of the fuel pump; and means for, when finishing first ignition processing, outputting from the mechanism the ON signal for instructing ON of the power source of the fuel pump.

5. A method of controlling fuel injection in an internal combustion engine in which no battery is mounted and that includes a fuel injection device for injecting a fuel devoted to combustion, and a power source circuit for rectifying and stabilizing an alternating current voltage generated by a power source comprising a generator, based on a rotation of a crank shaft of the internal combustion engine being started by rotating the crank shaft through a manual operation, whereby electrical generation power is by manual operation during a period when the power source voltage rises; the method comprising:

configuring a power source voltage detector to detect a value of a power source voltage supplied to the fuel injection device by the power source circuit; and configuring an information processor to perform first fuel injection processing of a starting operation when receiving a supply of a direct current voltage from the power source circuit;

initializing the power source voltage value detected by the power source voltage detection mechanism;

instructing a first fuel injection for the fuel injection device when the input voltage value attains a predetermined voltage value; and when finishing own initialization, outputting from the information processor an ON signal for instruction ON of a power source of the fuel pump; outputting from the mechanism, when finishing the first fuel injection processing, an OFF signal for instructing OFF of the power source of the fuel pump; and when finishing first ignition processing, outputting from the mechanism the ON signal for instructing ON of the power source of the fuel pump.

* * * * *